United States Patent [19]

Daddato

[11] 4,240,621

[45] Dec. 23, 1980

[54] MULTIDIRECTIONAL VISE SQUARE DEVICE

[76] Inventor: Dominic Daddato, 8043 Elden Ave., Whittier, Calif. 90602

[21] Appl. No.: 905,848

[22] Filed: May 15, 1978

Related U.S. Application Data

[63] Continuation-in-part of Ser. No. 820,255, Jul. 29, 1977, abandoned.

[51] Int. Cl.[3] ..... B25B 1/24

[52] U.S. Cl. ..... 269/264; 269/279

[58] Field of Search ..... 269/157–163, 269/258–264, 279–280, 224, 88; 254/101

[56] References Cited

U.S. PATENT DOCUMENTS

| | | | |
|---|---|---|---|
| 1,807,795 | 6/1931 | Pope | 269/258 |
| 1,918,439 | 7/1933 | Warman | 269/258 |
| 2,580,585 | 1/1952 | Odin | 269/264 |
| 2,838,971 | 6/1958 | Shekter | 269/279 |
| 4,084,791 | 4/1978 | Margueratt | 254/101 |

*Primary Examiner*—Robert C. Watson

*Attorney, Agent, or Firm*—Boniard I. Brown

[57] ABSTRACT

A vise square device for use between the jaws of a conventional vise to engage an irregular or inclined workpiece under clamping force to firmly seat and secure the workpiece, comprises first and second engaging plates having confronting recesses for receiving a spherical element, and at least one resilient member secured between the plates to provide a unitary device, the resilient member being deformable to accommodate relative movement between the plates and the spherical element to allow multi-directional plate adjustment to accommodate workpieces of irregular or inclined configuration. Serrations are preferably provided on the article-engaging plate face for improved securement of a workpiece.

21 Claims, 17 Drawing Figures

FIG. 5.
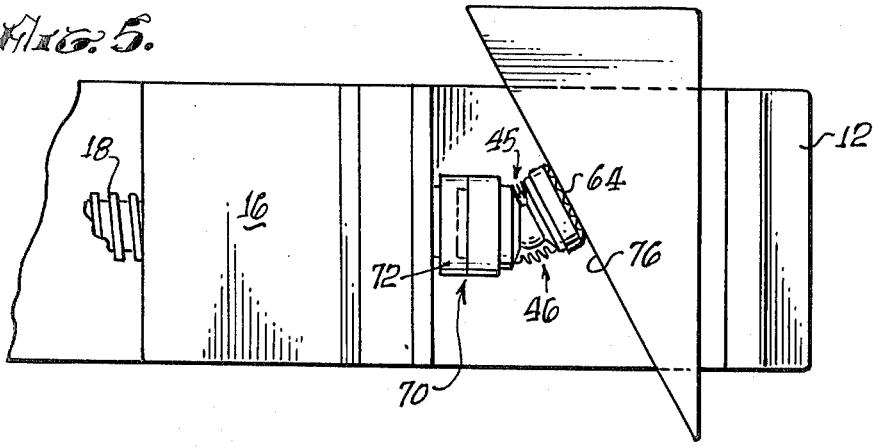
FIG. 6.
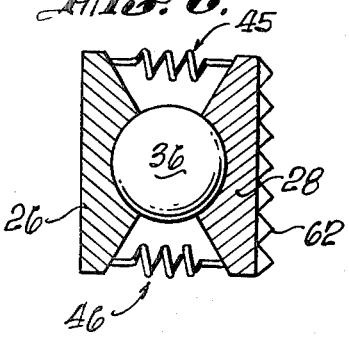
FIG. 8.
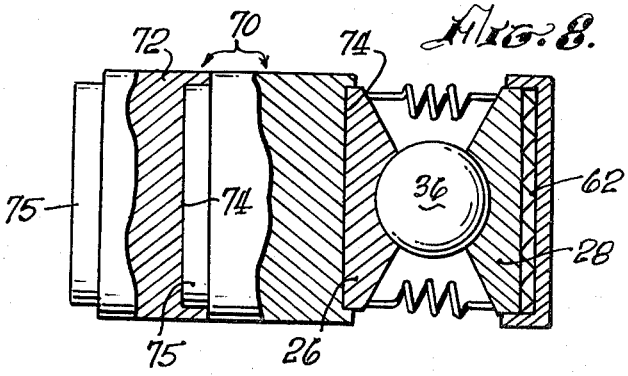
FIG. 7.
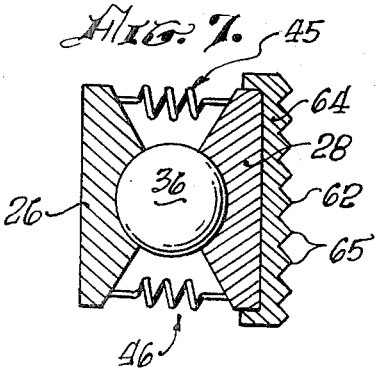
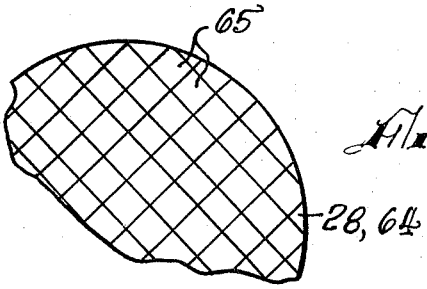
FIG. 9.
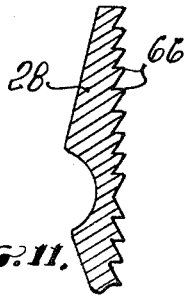
FIG. 11.
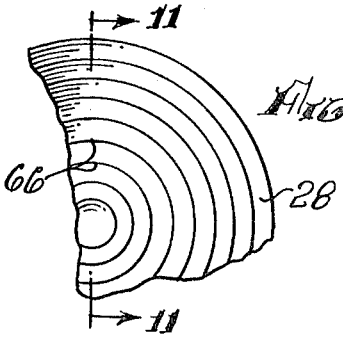
FIG. 10.

MULTIDIRECTIONAL VISE SQUARE DEVICE

RELATED APPLICATIONS

This application is a continuation-in-part of application Ser. No. 820,255, filed July 29, 1977, now abandoned.

BACKGROUND OF THE INVENTION

1. Field of the Invention

The invention relates generally to devices for use with vise mechanisms, and more particularly to a multidirectional vise square device for mounting between the jaws of a vise to adjust multidirectionally to accommodate irregular workpiece configurations under clamping force.

2. Description of the Prior Art

Various types of devices have been utilized toward resolving the problem of securing irregularly shaped workpieces between the jaws of a vise under clamping force.

Examples of such prior devices are shown and described in U.S. Pat. Nos. 219,719; 228,245; 331,164; 2,580,585; 2,720,126; and 2,792,731.

Various prior devices have respective shortcomings. Some do not provide good securement of an irregularly shaped workpiece, and workpieces tend to become loosened and disengaged. Some devices are incorporated in other apparatus or components, and do not comprise convenient unitary devices. Some are not capable of securing a workpiece having a substantially inclined surface. Some devices are relatively complicated and costly.

SUMMARY OF THE INVENTION

The present invention comprises a vise square device for securing irregularly shaped workpieces between the jaws of a vise mechanism. The vise square device comprises first and second engaging plates, the first plate having a face adapted for engagement with a vise jaw and a second plate having a surface adapted by hardening and preferably by serrations, for engagement with irregularly shaped workpieces. The confronting sides of the plates have recesses adapted to receive a spherical member or ball. At least one resilient member interconnects the plates about the spherical member to secure the components in a unitary device. The resilient member is deformable to permit relative movement between the plates and the spherical member to accommodate multidirectional plate adjustment to accommodate irregularly shaped workpieces. Serrations are preferably provided on the workpiece-engaging surface of the second plate for improved securement of a workpiece. In preferred embodiments, the resilient member is a resilient annular body or spring members secured to each of the plates.

DESCRIPTION OF THE DRAWINGS

FIG. 5 is a plan view of a portion of the vise of FIG. 1 in operative relation with a workpiece and the vise square assembly of FIG. 8, including extension blocks;

FIG. 6 is an enlarged sectional view of the vise square device shown in FIG. 5;

FIG. 7 is an enlarged sectional view like that of FIG. 6, showing a detachable cap member utilized with the device;

FIG. 8 is a sectional view of an assembly including the vise square device of FIG. 6 and extension blocks;

FIGS. 9 and 10 are fragmentary views showing types of serrated plate surfaces utilized with the invention;

FIG. 11 is a sectional view taken at line 11—11 in FIG. 10;

DESCRIPTION OF THE PREFERRED EMBODIMENTS

Figure 1:
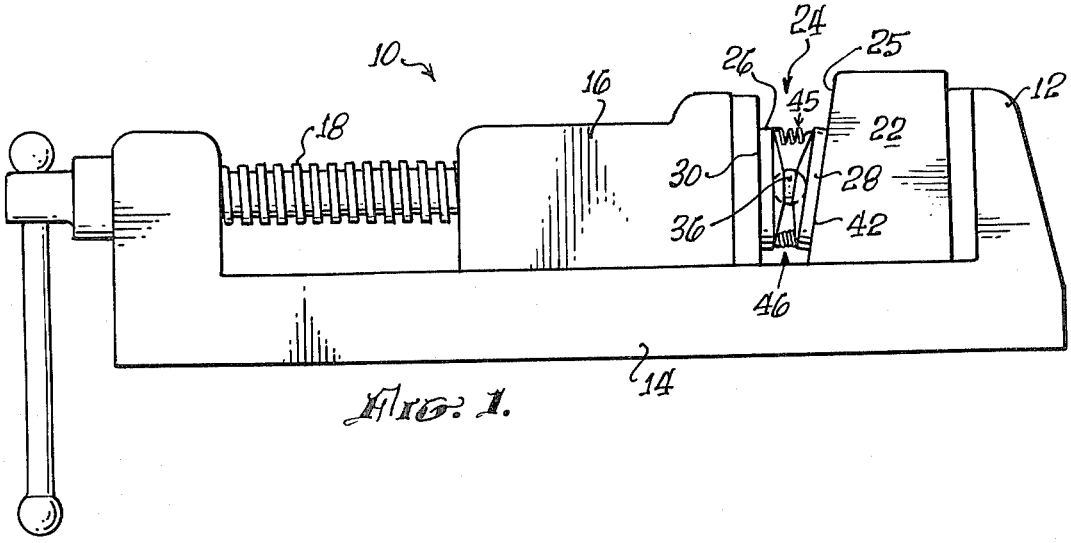
FIG. 1 is an elevational view of a conventional vise mechanism with a vise square device according to the present invention and a workpiece in operative relation with the vise.

Referring to the drawings, FIG. 1 shows a conventional vise mechanism 10 having a stationary jaw member 12, a body 14 and a movable jaw member 16 operated by a lead screw 18. A workpiece 22 and a vise square device 24 of the invention are mounted with the device between vise jaw 16 and the inclined surface 25 of the workpiece.

Vise square device 24 comprises a first engaging plate 26 and a second engaging plate 28. Plate 26 has a smooth face 30 and an opposite side 32 which has a frustro-conical surface 34 and a central recess 35 having the configuration of a spherical sector cap. Plate 28 has one side with a similar frustro-conical surface 38 and central recess 40, and a hardened engaging face or surface 42 for service in contact with workpieces. A spherical element or ball-bearing member is adapted for rotatable engagement in recesses 35, 40.

Figure 2:
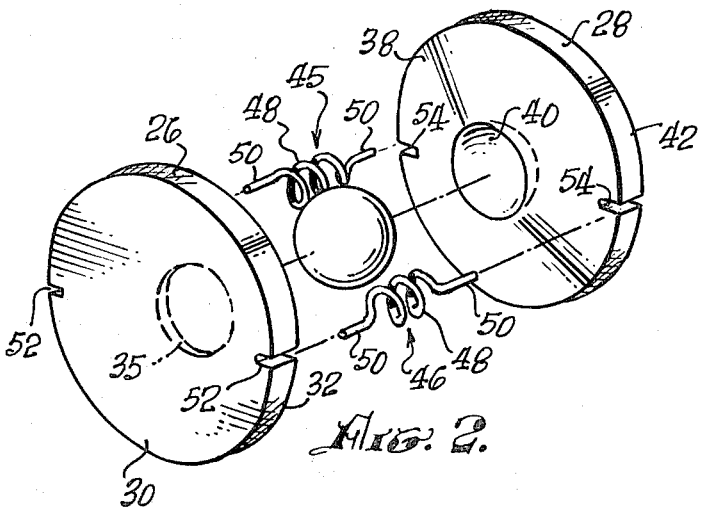
FIG. 2 is an exploded perspective view of the vise square device of FIG. 1.
Figure 3:
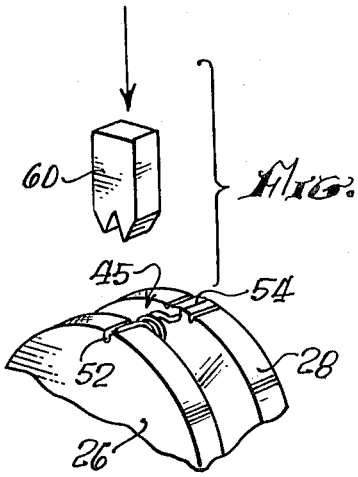
FIG. 3 is a fragmentary perspective view showing a manner of assemblying components of the vise square device of FIG. 2.
Figure 4:
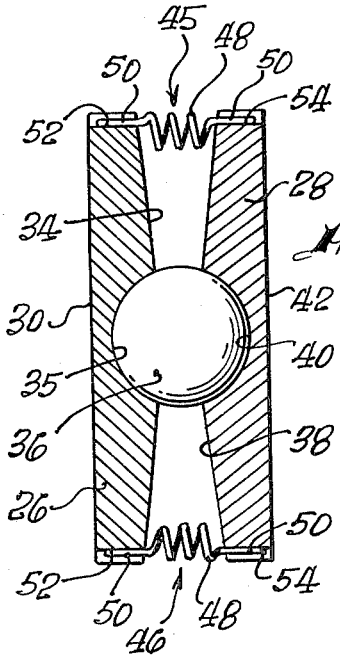
FIG. 4 is an enlarged sectional view of the vise square of FIGS. 1 and 2.

A pair of spring members 45, 46 secure the plates and the spherical element together in a unitary device. As shown in FIGS. 2 and 4, each spring has a coil portion 48 and end finger portions 50 received in diametrically opposed peripheral slots 52, 54 of plates 26, 28, respectively. End portions 50 of the springs are secured in the slots by conventional means, such as by swaging material adjacent to the slots by a swaging tool 60, as indicated in FIG. 3.

The springs 45, 46 provide resilient means which permit relative movement and rotation of the plates relative to the spherical element under deforming forces, and serve as biasing means to maintain the plates in parallel relationship when not under deforming load.

Serrations or teeth are preferably provided on the article-engaging face of the second plate 28 to provide improved gripping and to insure against disengagement of a workpiece during application of clamping force by a vise and to maintain the article secured in the vise. The serrations 62 may be formed integrally with the plate, as indicated in FIG. 6, or may be provided by attaching a serrated removable cap member 64, as shown in FIG. 7. The serrations or teeth may have various configurations, such as the diamond-shaped teeth 65 of FIG. 9, the parallel serrations indicated by FIG. 6, or the circular serrations of FIGS. 10 and 11. A serrated plate face may be covered by a smooth hardened cap member for particular applications, as indicated in FIG. 8. The serrations enable the vise square device to maintain securement of articles of various configurations under vise clamping forces, including surfaces inclined to 60° relative to the face of the vise jaw.

Referring to FIGS. 8 and 5, auxiliary extension blocks 70 each comprises an annular body member 72 having a recess 74 in one end portion and a boss 75 at its opposite end portion, the recess being adapted to receive plate 26 of the vise square device or the boss 75 of another extension block.

Figure 12:
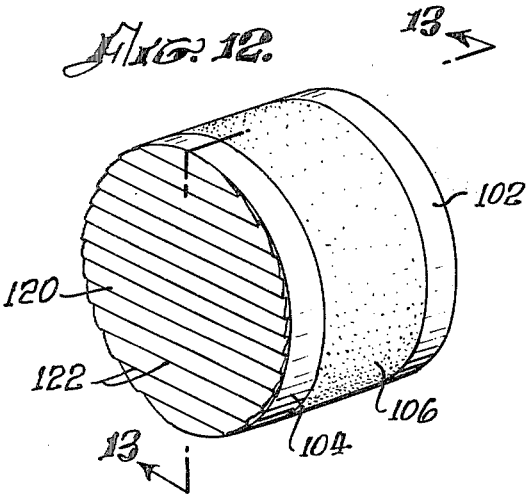
FIG. 12 is a perspective view of a preferred embodiment of the vise square device of the invention.
Figure 13:
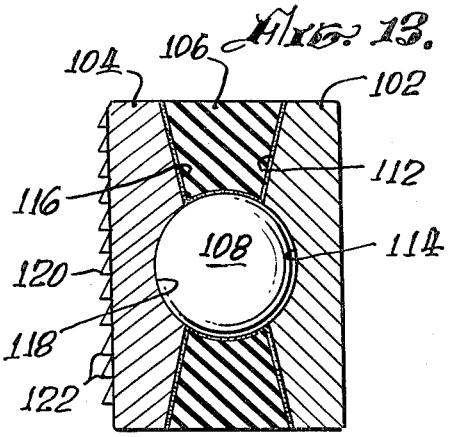
FIG. 13 is a sectional view taken at line 13—13 in FIG. 12.
Figure 14:
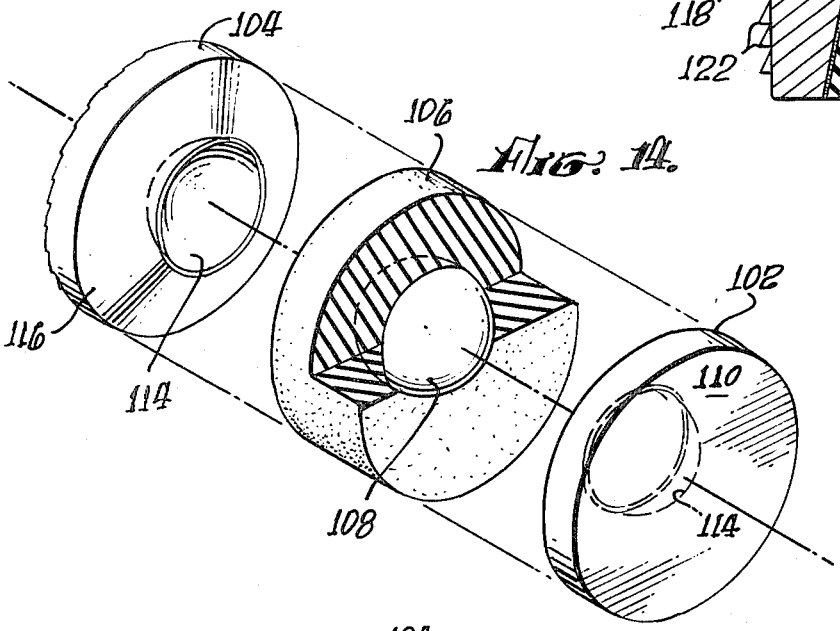
FIG. 14 is an exploded perspective view of the vise square device of FIGS. 12 and 13.

FIGS. 12 to 14 illustrate a preferred embodiment of the invention which functions in similar manner and for similar purposes, as the embodiment illustrated in FIGS. 1 through 8, and earlier described. The vise square device 100 comprises a first engaging plate 102, a second engaging plate 104, an annular resilient member 106 and a spherical element or ball 108. The outer engaging surface 110 of plate 102 is flat and the opposite side has a frustro-conical portion 112 about a central recess 114. Plate 104 has a similar side with a frustro-conical portion 116 and recess 118. The outer engaging side 120 is serrated having teeth 122 for securing a workpiece against slippage, and is preferably hardened for forceable engagement. Each of the recesses 114, 118 has the configuration of a spherical sector cap, thus to receive spherical element 108 in rotatable relation.

Resilient annular member 106 is preferably fabricated of neoprene rubber or appropriate thermoplastic material, and is secured, as by bonding or appropriate adhesive, to the surfaces 112, 116 of plate members 102, 104, respectively, thus securing the components in a unitary device.

Figure 17:
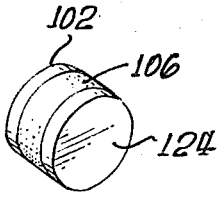
FIG. 17 is a small perspective view of a modified form of the device of FIG. 12.

FIG. 17 shows a form of the device similar to that shown in FIG. 12, except that its article engaging face 124 is flat for use in certain applications, such as where serrations might mar or damage an article under clamping force.

Serrations such as serrations 120 are preferably provided on the article-engaging plate of the device of FIGS. 12 and 13, as in the embodiment of FIGS. 5 to 7. The serrations or teeth may be formed integrally on the plate 104, or may be provided on a detachable cap like that of FIG. 7, or by other appropriate means. The serrations may have various configurations, including those indicated in FIGS. 9 through 11.

Figure 15:
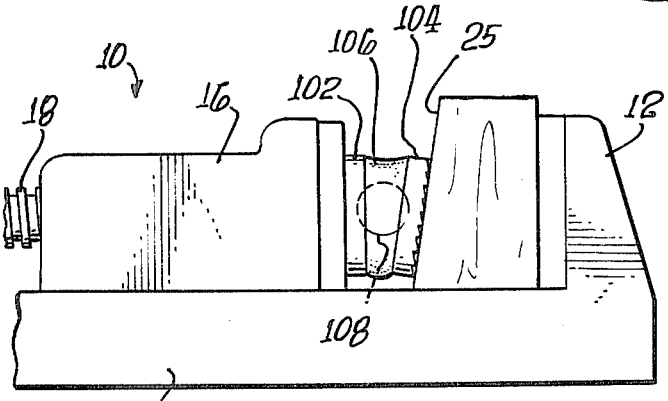
FIG. 15 is a partial elevational view of the vise mechanism of FIG. 1 in operative relation with a workpiece and the vise square device of FIGS. 12 and 13.
Figure 16:
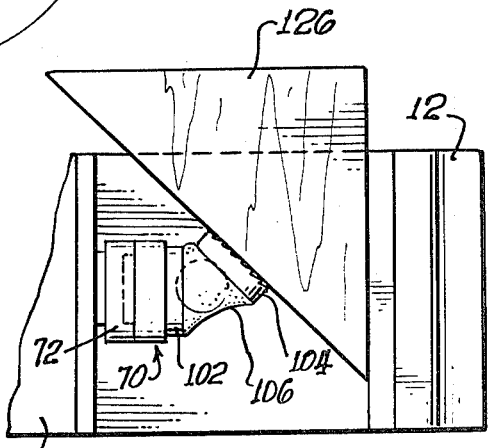
FIG. 16 is a fragmentary plan view of the vise mechanism of FIG. 1 in operative relation with the vise square device of FIGS. 12 and 13 and another workpiece.

The general function and utilization of the vise square device of FIGS. 12 through 17 are similar to those earlier described in relation to the device of FIGS. 2 through 8. As indicated in FIGS. 15 and 16, it is utilized in vise mechanisms such as that of FIGS. 1 and 5, wherein it is clamped with a workpiece. Resilient member 106 is deformable to permit rotative movement of the engaging plates relative to the spherical element or ball under clamping force, thus to enable and effect multi-directional orientation of the engaging plate with workpieces of various configurations and inclinations securely and without slipping. The device thus accommodates substantial irregularities and workpiece inclinations such as 60°.

Like the spring elements of the embodiment of FIGS. 2 and 4, resilient member 106 serves as biasing means to return the plates to parallel relation when the device is not under deforming load.

The inventor claims:

1. A unitary vise square device adapted to secure an irregularly shaped workpiece between the opposed jaws of a vise under clamping force, said device comprising:

a first plate having a jaw-engaging face and an opposite side defining a concave recess, a second plate having a workpiece-engaging face and an opposite side defining a concave recess and confronting the first plate, said opposite side of at least one of said first and second plates being inclined outwardly of the recess to prevent interference between the plates upon relative angular displacement therebetween, at least one of said concave recesses comprising a spherical sector cap surface no larger than hemispherical, a spherical bearing member configurated to interfit the confronting recesses of the first and second plates, whereby the plates are positionally adjustable through substantial relative angles to accommodate the irregular shape of the workpiece, and resilient biasing means interconnecting the plates and securing the plates and the spherical member in a unitary assembly, whereby the biasing means is deformable under vise clamping force to accommodate relative movement between the plates and the spherical member to secure the second plate and the workpiece under the vise clamping force.

2. A vise square device according to claim 1, wherein:

the spherical member is a ball bearing.

3. A vise square device according to claim 1, wherein:

said resilient means comprises at least one resilient member secured to the first and second plates outwardly of said concave recesses.

4. A vise square device according to claim 3, wherein:

the resilient member is fabricated of rubber.

5. A vise square device according to claim 3, wherein:

the resilient member is a body of thermoplastic material.

6. A vise square device according to claim 3, wherein:

the first and second plates are substantially solids of revolution and the resilient means is an annular resilient member disposed about the spherical member and adhered to the confronting sides of the first and second plates radially outwardly of their respective recesses.

7. A vise square device according to claim 1, wherein:

said resilient biasing means comprises spring members spaced from the bearing member and from each other.

8. A vise square device according to claim 1 or claim 7, wherein:

said resilient means serves as biasing means normally aligning the plates in parallel relationship.

9. A vise square device according to claim 1 or claim 7, wherein:

the second plate carries serrations to secure the workpiece.

10. A vise square device according to claim 8 or claim 7, and further including:

a cap member detachably mounted on the second plate and having a serrated surface.

11. A vise square device according to claim 1 or claim 7, wherein:

the first and second plate are substantially annular solids of revolution, and wherein the respective sides of the first and second plates are frustro-conical radially outwardly of their respective recesses to prevent interference therebetween upon substantial relative angular movement of the plates about the spherical member.

12. A vise square device according to claim 7, wherein:

the spring members are a pair of coil springs oppositely disposed relative to each other and secured to the peripheral edges of the respective plates, each of the spring members having oppositely extending finger portions secured to respective plates, and securing means in the respective plates to secure each spring member therebetween.

13. A multidirectional vise square as recited in claim 12, wherein said securing means comprises slots, oppositely disposed in the peripheral edges of said plates, in which said fingers are fixedly received.

14. A multidirectional vise square as recited in claim 13, wherein the face of said second plate has a serrated surface to maintain securement of the workpiece upon engagement with a workpiece surface inclined up to 35° relative to the face of the vise jaw.

15. A multidirectional vise square as recited in claim 13, wherein said device includes a removable cap member having a hard engaging face wherein said cap is removably mounted to said second plate.

16. A multidirectional vise square as recited in claim 15, wherein said cap-member-engaging face is formed having a serrated surface.

17. A multidirectional vise square device according to claim 7, wherein the spring members are coil spring members having finger portions for securement to the plates.

18. A multidirectional vise square device according to claim 17, wherein the finger portions of the spring members are secured in peripheral slots in the respective plates by pressing plate material about the finger portions.

19. A vise square device according to claim 1 or claim 6, wherein:

each of said concave recesses in the first and second plates has a spherical sector cap surface smaller than hemispherical.

20. A vise square device according to claim 1 or claim 2 or claim 7, wherein:

said resilient biasing means interconnecting the plates is disposed outwardly of the spherical bearing member.

21. A vise square device according to claim 1 or claim 6 or claim 7, wherein:

each of said opposite sides of the first and second plates is inclined outwardly of the recess to prevent interference between the plates upon relative angular displacement therebetween.

* * * * *